United States Patent [19]

Fukui et al.

[11] 3,957,620

[45] May 18, 1976

[54] PROCESS FOR TREATING HEAVY OIL

[75] Inventors: Yukimasa Fukui; Teikichi Hosoi; Hisashi Makita; Heihachiro Mukaida; Toshiro Takahashi, all of Yokkaichi, Japan

[73] Assignee: Daikyo Oil Company Ltd., Tokyo, Japan

[22] Filed: Aug. 13, 1973

[21] Appl. No.: 387,551

[30] Foreign Application Priority Data

Dec. 30, 1972 Japan ..... 48-2366

[52] U.S. Cl. ..... 208/46; 48/197 R; 201/17; 208/126

[51] Int. Cl.[2] ..... C10G 9/02

[58] Field of Search ..... 208/46, 106, 131, 125, 208/126, 127; 201/17

[56] References Cited

UNITED STATES PATENTS

| | | | |
|---|---|---|---|
| 2,921,017 | 1/1960 | Johnson et al. | 208/106 |
| 3,179,584 | 4/1965 | Hamner et al. | 208/106 |
| 3,600,130 | 8/1971 | Aldridge et al. | 201/17 |
| 3,745,109 | 7/1973 | Heredy et al. | 208/125 |
| 3,803,023 | 4/1974 | Hamner | 208/46 |

*Primary Examiner*—Herbert Levine
*Attorney, Agent, or Firm*—Fred Philpitt

[57] ABSTRACT

In the treatment of petroleum heavy oil by thermally cracking a petroleum heavy oil mixed with an alkali metal carbonate or carbonates at a cracking temperature of 450° to 650°C and recovering the resulting low sulfur liquid hydrocarbon and light hydrocarbon gas, (1) gasification of residual coke produced by said cracking, in the presence of the alkali metal carbonate or carbonates and an alkali metal sulfide or sulfides by-produced during the cracking, with steam alone or steam together with an oxygen-containing gas, at 550° to 800°C and under the atmospheric pressure to 10 atm. to produce a hydrogen- and $CO_2$— rich gas, and (2) regeneration from said by-produced alkali metal sulfide or sulfides to said alkali metal carbonate or carbonates, with $CO_2$ gas produced by said gasification and steam, are simultaneously carried out in the same reaction zone.

1 Claim, No Drawings

PROCESS FOR TREATING HEAVY OIL

DESCRIPTION OF THE INVENTION

The present invention relates to a process for treating heavy petroleum oil. More particularly, it relates to a process comprising (1) the gasification of residual coke, which is by-produced when low sulfur liquid hydrocarbons and light hydrocarbon gas are produced from petroleum heavy oil containing asphalt, using an alkali metal carbonate in the presence of the alkali metal carbonate and an alkali metal sulfide converted therefrom, and (2) the regeneration simultaneous with said gasification, from the alkali metal sulfide to alkali metal carbonate which is carried out in the same reaction zone with that of said gasification, with $CO_2$ gas produced by said gasification and steam.

In other words, when the above-mentioned heavy oil is subjected to thermal cracking with an alkali metal carbonate or more than one kind of alkali metal carbonates to recover low sulfur liquid hydrocarbons and light hydrocarbon gas, problems are brought about as to how to treat the resulting residual coke and how to regenerate the alkali carbonate or carbonates from the alkali sulfide or sulfides by-produced at the time of desulfurization of the heavy oil.

The present invention provides a method for solving these problems in which the residual coke containing by-produced alkali metal sulfide or sulfides is subjected to steam-treatment at a relatively low temperature whereby gasification of the coke and regeneration of the alkali carbonate or carbonates from the alkali sulfide or sulfides, are carried out at the same time and in the same reactor.

Gasification of coke with steam at high temperatures has heretofore been well known, and conversion of alkali metal sulfides into alkali metal carbonates with $CO_2$ gas and steam is also a well known fact. However, the gasification reaction of coke with steam has been usually carried out at a high temperature range of 950°–1200°C, and lower temperatures below 800°C, have not been applied to the gasification due to small gasification rate. For example, according to the data of Harries (*J. F. Gas Ber.* 37, 82 (1894)), the conversion of steam at the time of the gasification reaction of coke with steam in the temperature range of 678°–1125°C, and the analysis of the resulting gases, are shown in the following Table 1:

Table 1

| Temperature (°C) | Reaction of Coke with Steam Conversion of Steam (%) | Gas Composition $CO_2$ | CO | $H_2$ |
|---|---|---|---|---|
| 678 | 8.8 | 29.8 | 4.9 | 65.2 |
| 758 | 25.3 | 27.0 | 7.8 | 65.2 |
| 838 | 41.0 | 22.9 | 15.1 | 61.9 |
| 954 | 70.2 | 6.8 | 39.3 | 53.5 |
| 1010 | 94.0 | 1.5 | 49.7 | 48.8 |
| 1125 | 99.4 | 0.6 | 48.5 | 50.9 |

As seen in Table 1, at 678°C, the conversion of steam is very low, i.e. 8.8%. Also, as for the gas composition, CO content is small and $CO_2$ content is large. This shows that, in order to increase the conversion of steam, i.e. the gasification rate of coke, it is necessary to carry out the gasification at a temperature of at least 1000°C.

In the present invention, since an alkali metal carbonate or carbonates are used as a heating medium, an extremely porous and non-graphitizing coke is formed during the thermal cracking of the heavy oil. Accordingly, the gasification with steam proceeds extremely fast due to the catalytic action of the alkali metal carbonate or carbonates, and coke is gasified even at an extremely low temperature such as 600°C–700°C which have never been applied. For comparison, both results of the coke gasification according to the method of the present invention and the gasification of a green coke produced according to conventional process are shown in Table 4.

The regeneration reaction of alkali metal carbonates from alkali metal sulfides is carried out by blowing $CO_2$ gas and steam into alkali metal sulfides. In this case, the equilibrium of the reaction shifts toward the original system as the temperature becomes higher. At the equilibrium, lower temperatures are preferable for the recovery of hydrogen sulfide, and it is said that the optimum temperature is about 430°C. In fact, also in our experiment in which the regeneration reaction of sodium carbonate from sodium sulfide was carried out at temperatures of 440°–880°C, the conversion of sodium sulfide decreased as the temperature became higher. The results are shown in Table 2. As apparent from Table 2, it is not advantageous to regenerate alkali metal carbonates from alkali metal sulfides above 800°C.

Table 2

Examples of the regeneration reaction of sodium carbonate from sodium sulfide

| | | | | | |
|---|---|---|---|---|---|
| Reaction temperature (°C) | 440 | 540 | 640 | 720 | 800 |
| Reaction time (min) | 15 | 30 | 30 | 30 | 30 |
| Alkali sulfide/steam (mol/mol/min) | 0.72 | 0.72 | 0.63 | 0.72 | 0.72 |
| Alkali sulfide/$CO_2$ gas (mol/mol/min) | 1.99 | 1.79 | 2.12 | 2.08 | 2.15 |
| Conversion of sodium sulfide(%) | 99.5 | 84.6 | 60.9 | 26.6 | 5.5 |

Recently, a molten carbonate process has been developed by The M. W. Kellogg Company. According to this process, coal is gasified with steam at a high temperature of 950°C in a bath of molten alkali carbonate, and at the same time, a part of the resulting by-produced alkali sulfide together with an excessive amount of the alkali carbonate is taken out, then once cooled to about room temperature, and made into an aqueous solution, followed by blowing $CO_2$ gas thereinto to convert the alkali sulfide into alkali carbonate. Therefore, in this process, the difference between the gasification temperature and the regeneration one is so large that heat efficiency seems to be reduced.

Further, according to a recent Japanese patent application No. 33102/1972 by Clyde L. Aldridge to ERE Co., solid carbonacious substances are gasified with steam, at a temperature of 593°–788°C, under a pressure of 14-141 Kg/cm$^2$ (G), using an alkali carbonate to produce a methane-rich gas.

Whereas, the method of the present invention is characterized in that coke is gasified at a temperature of 550°–800°C and under a pressure of atmospheric one to 10 atm., and regeneration of an alkali metal carbonate or carbonates from an alkali metal sulfide or sulfides is carried out in the same reactor, hence a hydrogen-rich gas containing almost no methane can be produced. Thus, the method of the present invention is essentially different from that of the above-mentioned patent application. These results are shown in Table 4. As seen from Table 4, methane gas was not observed in the product gas.

When an alkali metal carbonate is present in coke as in the present invention, gasification of the coke with steam proceeds rapidly even at a temperature of 600°–700°C, while in regeneration reaction of alkali metal carbonates from alkali metal sulfides, also a sufficiently high conversion can be obtained even at the above-mentioned temperatures. Thus, the regeneration of alkali metal carbonates from alkali metal sulfides and the gasification of coke can be carried out in the same reactor, i.e. without using two separate reactors for regeneration and gasification.

The following reactions proceed in the same reactor:

$$C + 2H_2O \longrightarrow CO_2 + 2H_2 - 18{,}000 \text{ Kcal} \quad (1)$$

$$C + H_2O \longrightarrow CO + H_2 - 28{,}000 \text{ Kcal} \quad (2)$$

$$C + O_2 \longrightarrow CO_2 + 97{,}600 \text{ Kcal} \quad (3)$$

$$M_2S + CO_2 + H_2O \longrightarrow M_2CO_3 + H_2S \quad (4)$$

(M : alkali metal)

The equations (1) and (2) are those of water-gasification reaction of coke. At lower temperatures as in the present invention, the reaction of the equation (2) scarcely proceeds, while the reaction of the equation (1) forming $H_2$ and $CO_2$ proceeds predominantly. If an oxygen-containing gas is supplied, combustion reaction of coke occurs and the reaction of the equation (3) proceeds.

As seen in the equation (4), alkali metal carbonate is regenerated from alkali metal sulfide with produced $CO_2$ gas and steam. The lower the temperature, the easier the proceeding of the reaction, and above 800°C, the reaction scarcely proceeds, while oxidation of alkali metal sulfide with steam proceeds and alkali sulfate is formed. Thus, it has been ascertained that the optimum temperature range in which the simultaneous gasification and regeneration of the present invention is carried out, is 550°–800°C, preferably 600°–700°C.

In addition, as seen from the above-mentioned explanation, it is also possible to supply an oxygen-containing gas in addition to steam to burn a part of coke and maintain the above-mentioned temperatures, since the water-gasification reaction of coke is an endothermic one.

As mentioned above, according to the present invention, light hydrocarbon gas and liquid hydrocarbons can be obtained by cracking of heavy oil, and also, residual coke containing an alkali metal sulfide or sulfides, by-produced at the time of desulfurization of heavy oil, can be gasified quickly at a relatively low temperature by supplying steam in the presence of an alkali metal carbonate or carbonates, while the regenerated alkali metal carbonate or carbonates can be reused as the heating medium for the thermal cracking of the heavy oil as well as the desulfurizing agent for the heavy oil.

The present invention will be further illustrated by the following Examples and Comparative Examples, but they are not to be construed as limitative to the scope of claims of the present invention.

EXAMPLE 1

100 g Of Gach Saran Vacuum Residue together with 100 g of anhydrous sodium carbonate were charged in a cylindrical retort of a high Ni-content steel (Inconel 600) having a capacity of about 600 ml.

A revolving type electromagnetic stirring apparatus is connected to the upper cover of the retort, and a revolving shaft having vanes is extended to the bottom of the retort. Further, onto the upper cover is attached a branch pipe for discharging cracking gas and liquid hydrocarbons produced by thermal cracking. The retort is inserted into an electric furnace, and the temperature was elevated. From about 430°C, thermal cracking starts, and cracking gas and liquid hydrocarbons are distilled off. Temperature elevation is further continued, and after the temperature reaches 550°C, coking is continued further for one hour. The yields of products at this time were as follows: gas, 13.5%; liquid hydrocarbon, 56.6%; and coke, 29.9%. Produced coke was fully washed with water, treated with 10% hydrochloric acid, washed again with water, and dried after the washing water showed a pH of about 7. The results are shown in Table 3 together with those of other Examples and Comparative Example.

Table 3

| | Thermal cracking of heavy oil | | | | |
|---|---|---|---|---|---|
| | Example 1 | Example 2 | Example 3 | Example 4 | Comparative Example 1 |
| Feed Stock | Gach Saran Vacuum Residue | Gach Saran Vacuum Residue | Khafji Vacuum Residue | Gach Saran Vacuum Residue | Khafji Vacuum Residue |
| Specific gravity (15/4°C) | 1.02 | 1.02 | 1.03 | 1.02 | 1.03 |
| Sulfur content (% by weight) | 3.3 | 3.3 | 6.0 | 3.3 | 6.0 |
| Conradson Carbon Residue (% by weight) | 19.1 | 19.1 | 17.5 | 19.1 | 17.5 |
| Alkali Metal Carbonate Reagent | $Na_2CO_3$ | $K_2CO_3$ | $K_2CO_3$ | $K_2CO_3$(40wt%) $Na_2CO_3$(30") $Li_2CO_3$(30") | — |
| Operating Conditions | | | | | |
| Feed Stock/alkali metal carbonate (weight/weight) | 1 | 1 | 1 | 1 | — |
| Temperature (°C) | 550 | 550 | 550 | 550 | 550 |
| Coking time (hr) | 1 | 1 | 1 | 1 | 1 |
| Yield of Products (% by weight) | | | | | |
| Gas | 13.5 | 14.2 | 14.3 | 16.2 | 9.9 |
| Liquid Hydrocarbon | 56.6 | 58.0 | 58.3 | 54.8 | 58.1 |
| Coke | 29.9 | 27.8 | 27.4 | 29.0 | 32.0 |
| Sulfur Content of Products | | | | | |
| Gas (% by mol) | 1.7 | 1.2 | 1.2 | 0.6 | 8.6 |
| Liquid Hydrocarbon (% by weight) | 1.2 | 1.0 | 2.7 | 1.4 | 3.1 |
| Coke (% by weight) | 1.7 | 1.5 | 2.2 | 2.0 | 7.8 |
| Produced Gas Composition (% by mol) | | | | | |
| Hydrogen | 37.5 | 51.8 | 64.7 | 77.7 | 19.3 |
| Hydrogen sulfide | 1.7 | 1.2 | 1.2 | 0.6 | 8.6 |
| $CO_2$ Gas | 2.0 | 1.5 | 2.3 | 2.8 | — |
| Methane | 30.2 | 16.7 | 15.1 | 7.9 | 33.8 |

Table 3-continued

| | Thermal cracking of heavy oil | | | | |
|---|---|---|---|---|---|
| | Example 1 | Example 2 | Example 3 | Example 4 | Comparative Example 1 |
| Ethane | 9.8 | 6.6 | 3.7 | 4.4 | 15.1 |
| Ethylene | 3.3 | 5.7 | 5.8 | 0.7 | 2.5 |
| Propane + | 15.5 | 16.5 | 7.2 | 5.9 | 20.7 |

s 17.85 g Of the above-mentioned dried raw coke (consisting of 74.5% by weight of sodium carbonate, 22.4% by weight of coke and 3.1% by weight of sodium sulfide) was fully pulverized and charged in a Tammann tube of high purity alumina (having an inner diameter of 25 mm $\phi$ and a length of 400 mm). The top end of the Tammann tube was sealed with a nitrile rubber plug through which a slender and elongated gas-blowing tube of high purity alumina (having an inner diameter of 3 mm $\phi$) was penetrated, one end of this tube extending to the bottom of said Tammann tube. The Tammann tube was introduced in a vertical type, tubular electric furnace. The temperature was elevated to 540°C under a flow of nitrogen gas at a given flow rate. At this temperature, water was fed through a microfeeder at a flow rate of 0.21 g/min ($11.7 \times 10^{-3}$ mol/min) and converted into steam by heating through a preheater. Steam was blown into Tammann tube together with nitrogen gas. It reacted with coke to turn into gaseous state, while the resulting $CO_2$ gas together with an excessive amount of steam reacted with sodium sulfide to regenerate sodium carbonate and generate hydrogen sulfide. The reaction carried out at 540°C for one hour resulted in a coke conversion of 25.0% and a conversion of sodium sulfide of 76.9%. The results are shown in Table 4 together with those of other Examples and Comparative Example.

ner as in Example 1. The resulting yields were as follows: gas, 14.2%; liquid hydrocarbon, 58.0%; and coke, 27.8%. The results are shown in Table 3.

19.05 g Of raw coke thus obtained (consisting of 75.6% by weight of potassium carbonate, 21.0% by weight of coke and 3.4% by weight of potassium sulfide) was sufficiently pulverized, and gasification and regeneration reactions were carried out at 590°C in the same manner as in Example 1. Gasification rate of coke was 56.0% and conversion of potassium sulfide was 71.9%. The results are shown in Table 4.

EXAMPLE 3

100 g Khafji Vacuum Residue together with 100 g of anhydrous potassium carbonate were charged in a retort, and cracking was carried out in the same manner as in Example 1. The yields were as follows: gas, 14.3%; liquid hydrocarbon, 58.3%; and coke, 27.4%. The results are shown in Table 3.

17.65 g Of raw coke thus obtained (consisting of 73.1% by weight of potassium carbonate, 22.6% by weight of coke and 4.3% by weight of potassium sulfide) was fully pulverized, and gasification and regneration reactions were carried out at 640°C in the same manner as in Example 1. Gasification rate of coke was 75.0% and conversion of potassium sulfide was 70.5%. The results are shown in Table 4.

EXAMPLE 4

Table 4

| | Gasification of coke and regeneration reaction of alkali sulfide (Oxygen was not used) | | | | | |
|---|---|---|---|---|---|---|
| | Example 1 | Example 2 | Example 3 | Example 4 | Example 5 | Comparative Example 1 |
| Kind of raw coke sample | Raw coke of Example 1 | Raw coke of Example 2 | Raw coke of Example 3 | Raw coke of Example 4 | Raw coke of Example 5 | Raw coke of Comparative Example 1 |
| Reaction temperature (°C) | 540 | 590 | 640 | 720 | 800 | 800 |
| Reaction time (hr) | 1 | 1 | 1 | 1 | 1 | 1 |
| Coke2)/carbonate (weight/weight) | 0.30 | 0.28 | 0.31 | 0.29 | 0.30 | — |
| Alkali sulfide/carbonate (weight/weight) | 0.04 | 0.046 | 0.058 | 0.03 | 0.04 | — |
| Steam/coke (weight/hr/weight) | 12 | 12 | 12 | 12 | 12 | 12 |
| Gasification rate of coke (%) 3) | 25.0 | 56.0 | 75.0 | 80.6 | 98.7 | 8.0 |
| Produced gas composition 4) (% by mol) | | | | | | |
| $H_2$ | 69.4 | 68.2 | 63.0 | 65.0 | 66.2 | 64.5 |
| $CO_2$ | 19.7 | 22.9 | 28.6 | 24.3 | 22.7 | 23.4 |
| CO | 0 | 0 | 4.6 | 8.2 | 10.2 | 12.1 |
| $H_2S$ | 10.9 | 9.0 | 3.8 | 2.5 | 0.9 | — |
| Conversion of alkali sulfide for regeneration (%) 5) | 76.9 | 71.9 | 70.5 | 53.2 | 6.0 | — |

Notes:
1) In this Comparative Example, green coke was gasified.
2) Raw coke obtained by cracking in the presence of alkali carbonate was used.
3) Calculated from the amount of unreacted coke remaining in the Tammann tube after the reaction.
4) Analysis was carried out using a gas chromatography apparatus. Average gas composition for 20 minutes after initiation of the reaction.
5) Calculated from the amount of hydrogen sulfide generated.

EXAMPLE 2

100 g Of Gach Saran Vacuum Residue together with 100 g of anhydrous potassium carbonate were filled in a retort, and cracking was carried out in the same man- 100 g Of Gach Saran Vacuum Residue (sulfur content: 3.3% by weight) together with 100 g of a mixture of carbonates consisting of 40% by weight of potassium carbonate, 30% by weight of sodium carbonate and 30% by weight of lithium carbonate, were charged in a retort, and cracking was carried out in the same manner as in Example 1. The yields were as follows: gas, 16.0%; liquid hydrocarbon, 54.8%; and coke, 29.0%. The results are shown in Table 3.

18.22 g Of raw coke thus obtained (consisting of 75.7% by weight of mixture of carbonates, 22.0% by weight of coke and 2.3% by weight of alkali sulfide) was sufficiently pulverized, and gasification and regeneration reactions were carried out at 720°C in the same manner as in Example 1. Gasification rate of coke was 80.6% and conversion of alkali sulfide was 53.2%. The results are shown in Table 4.

EXAMPLE 5

18.1 g Of raw coke obtained in Example 1 was sufficiently pulverized, and gasification and regeneration reactions were carried out at 800°C in the same manner as in Example 1. Gasification rate of coke was 98.7% and conversion of sodium sulfide was 6.0%. The results are shown in Table 4.

COMPARATIVE EXAMPLE 1

100 g Of Khafji Vacuum Residue (sulfur content: 6.0% by weight) alone was charged in a retort without mixing with alkali carbonate, and cracking was carried out in the same manner as in Example 1. The yields were as follows: gas, 9.9%; liquid hydrocarbon, 58.1%; and coke, 32.0%. The results are shown in Table 3.

4 g Of coke thus obtained was charged together with 42 g of sea sand, in a Tammann tube. The coke was gasified with steam at a reaction temperature of 800°C, in the same manner as in Example 1 except that no alkali sulfide nor alkali carbonate was used. In this case, gasification reaction scarcely proceeded at 800°C in the absence of alkali metal carbonate to give a gasification rate of coke of 8.0%. The results are shown in Table 4.

What is claimed is:

1. A process comprising:

a. heating a sulfur-containing, heavy hydrocarbon oil containing at least one alkali metal carbonate, in a cracking zone at a temperature of about 450° to 650° and for a time sufficient to produce a gaseous hydrocarbon product and a light hydrocarbon liquid product and convert a substantial portion of the sulfur contained in said heavy hydrocarbon oil to alkali metal sulfide, while maintaining said alkali metal carbonate and said heavy hydrocarbon oil at a weight ratio sufficient to produce a residual coke by-product containing alkali metal carbonate, coke and alkali metal sulfide and having a weight ratio of alkali metal carbonate to coke of at least about 3 to 1, b. withdrawing said gaseous hydrocarbon product, said hydrocarbon liquid product and said residual coke by-product from said cracking zone, c. transferring said residual coke by-product to a separate gasification zone, d. contacting said residual coke by-product with steam in said gasification zone, at a temperature of about 550° to 800°C and under a pressure of about 1 to 10 atmospheres, to gasify at least a portion of said coke and product a $H_2$— and $CO_2$—rich gas, while maintaining said residual coke by-product in said gasification zone for a time sufficient to react said stream and said $CO_2$ with said alkali metal sulfide to convert a substantial portion thereof to alkali metal carbonate and produce a gaseous product and a residual alkali metal carbonate product, e. withdrawing said gaseous product and said residual alkali metal carbonate from said gasification zone, and f. recycling at least a part of said residual alkali metal carbonate to said cracking zone.

* * * * *